US011473734B2

(12) United States Patent
Yan et al.

(10) Patent No.: US 11,473,734 B2
(45) Date of Patent: Oct. 18, 2022

(54) LED LIGHTING BULB AND MANUFACTURING METHOD

(71) Applicant: SIGNIFY HOLDING B.V., Eindhoven (NL)

(72) Inventors: Chengrui Yan, Shanghai (CN); Rui Zou, Shanghai (CN); Morna Shen, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/440,102

(22) PCT Filed: Mar. 16, 2020

(86) PCT No.: PCT/EP2020/057034
§ 371 (c)(1),
(2) Date: Sep. 16, 2021

(87) PCT Pub. No.: WO2020/187816
PCT Pub. Date: Sep. 24, 2020

(65) Prior Publication Data

US 2022/0186888 A1 Jun. 16, 2022

(30) Foreign Application Priority Data

Mar. 19, 2019 (WO) ..... PCT/CN2019/078751
Apr. 29, 2019 (EP) ..... 19171505
May 2, 2019 (EP) ..... 19172221

(51) Int. Cl.
*F21K 9/66* (2016.01)
*F21K 9/232* (2016.01)
(Continued)

(52) U.S. Cl.
CPC ..... *F21K 9/232* (2016.08); *F21K 9/238* (2016.08); *F21K 9/90* (2013.01)

(58) Field of Classification Search
CPC . F21K 9/232; F21K 9/238; F21K 9/90; F21K 9/237; F21K 9/272; F21K 9/278;
(Continued)

(56) References Cited

U.S. PATENT DOCUMENTS

2010/0253221 A1 10/2010 Chiang
2013/0271989 A1 10/2013 Hussell et al.
(Continued)

FOREIGN PATENT DOCUMENTS

CN 103225757 B 5/2015
CN 204962336 U 1/2016
(Continued)

*Primary Examiner* — Omar Rojas Cadima
(74) *Attorney, Agent, or Firm* — Daniel J. Piotrowski

(57) ABSTRACT

A LED lighting bulb (10) has a lighting driver (28) which is located within the bulb envelope (12). During assembly, the lighting driver (28) may be positioned away from an opening (14) of the envelope (12) so that high temperature sealing of a stem portion (22) of the end cap (16) to the envelope opening (12) can take place. The lighting driver (28) can then be pulled into position against the stem portion (22), and assembly of the end cap (16) can then be completed.

15 Claims, 6 Drawing Sheets

(51) Int. Cl.
*F21K 9/90* (2016.01)
*F21K 9/238* (2016.01)

(58) Field of Classification Search
CPC .... F21V 19/0025; F21V 23/06; F21V 23/002; F21V 29/506; F21V 31/00; F21V 31/005; F21V 29/503; H01J 5/50; H01K 1/46; F21Y 2115/10
See application file for complete search history.

(56) References Cited

U.S. PATENT DOCUMENTS

| | | | | |
|---|---|---|---|---|
| 2019/0120438 | A1* | 4/2019 | Wan | H05K 1/189 |
| 2019/0271442 | A1* | 9/2019 | Ren | F21K 9/232 |

FOREIGN PATENT DOCUMENTS

| | | | | |
|---|---|---|---|---|
| CN | 105953102 | A | * | 9/2016 |
| CN | 106439533 | A | | 7/2017 |
| JP | 2010245037 | A | | 10/2010 |
| JP | 2012074251 | A | | 4/2012 |
| WO | 2016145923 | A1 | | 9/2016 |

* cited by examiner

LED LIGHTING BULB AND MANUFACTURING METHOD

CROSS-REFERENCE TO PRIOR APPLICATIONS

This application is the U.S. National Phase application under 35 U.S.C. § 371 of International Application No. PCT/EP2020/057034, filed on Mar. 16, 2020, which claims the benefit of International Application No. PCT/CN2019/078751, filed on Mar. 19, 2019, European Patent Application 19171505.1, filed on Apr. 29, 2019, and European Patent Application No. 19172221.4, filed on May 2, 2019. These applications are hereby incorporated by reference herein.

FIELD OF THE INVENTION

This invention relates to a LED lighting bulb and manufacturing method, and in particular to a bulb which incorporates a lighting driver.

BACKGROUND OF THE INVENTION

A LED lighting bulb, in particular which is able to be driven by mains power, requires a lighting driver circuit to be incorporated into the bulb. The lighting driver may for example be a switch mode power converter or other type of driver circuit.

A LED lighting bulb typically comprises a glass envelope and an end cap which closes an opening in the glass envelope and defines the external terminal contacts of the bulb. The end cap may be an Edison screw fitting (e.g. E17 or E27) or a bayonet cap (e.g. B15 or B22) or a pin connector (e.g. MR16). The end cap is located outside the envelope and for example has (or is attached to) a stem which seals the opening in the envelope.

The known approach is to position the lighting driver in the end cap. The stem of the end cap can be sealed to the glass envelope before the lighting driver is connected. Assembly of the end cap is then involves connecting the lighting driver and connecting the terminals of the end cap to the lighting driver.

However, this places a limitation on the possible size of the lighting driver. If the lighting driver is too large to fit within the end cap, the end cap may be deliberately enlarged to provide additional internal space for the lighting driver. This detracts from the aesthetic appearance of the bulb and also adds to the overall size of the bulb which may not be desired.

This increase in the size of the end cap could be avoided if use could be made of the internal volume of the envelope to house the lighting driver. However, this poses a problem that the connection between the end cap and the envelope can damage the lighting driver. In particular, for a glass envelope this may be a high temperature sintering process. The temperatures involved will damage the lighting driver.

There is therefore a need to enable use of the space inside the envelope but without risking damage to the lighting driver.

WO2016/145923A1, CN103225757B, US2013/0271989A1 and US20100253221A1 disclose different structures of LED bulbs. However, above problem is not mentioned or solved.

SUMMARY OF THE INVENTION

The invention is defined by the claims.

According to examples in accordance with an aspect of the invention, there is provided a LED lighting bulb comprising:

an envelope having an opening;

an LED arrangement being enclosed in the envelope;

an end cap at the opening comprising a first terminal, a second terminal and a stem portion which closes the opening;

a first wire and a second wire extending from the stem portion into the envelope;

a lighting driver at an envelope side of the stem portion, the lighting driver comprising a shape feature for allowing the lighting driver to slide relative to the first wire and the second wire during assembly, and the lighting driver being electrically connected to the first wire and the second wire;

a first tube extending from the stem portion on an opposite side to the envelope;

a second tube extending from the stem portion on an opposite side to the envelope; and a first supply wire which makes electrical connection between the first terminal and the lighting driver through the first tube and through the stem portion; and a second supply wire which makes electrical connection between the second terminal and the lighting driver through the second tube and through the stem portion.

This bulb has a lighting driver on the envelope side of the stem portion of the end cap, i.e. within the bulb envelope. To protect the lighting driver during assembly, for example during sintering of the envelope to the stem portion (to seal the envelope), the lighting driver is slideable along the first and second wires. This means the assembly can take place with the lighting driver remote from the stem portion, and after assembly, the lighting driver can be pulled back to the stem portion using the first and second supply wires. Thus, during assembly the lighting driver is able to slide along (or over or between) the first wire and the second wire. The lighting driver can be positioned within the interior volume of the envelope, and does not need to be confined to an internal volume of the end cap.

By pulling the driver back the to stem portion, it is moved out of the main volume of the envelope as much as possible, so that the appearance of the envelope is closer to a traditional incandescent lamp, with an uncluttered internal volume. An uncluttered internal volume also avoids shadowing, which could result if the driver is located within the envelope near to the light source (e.g. LED filament) and thereby block some of the LED light, creating shadows in the output light. It also means the positioning of the light source can be freely selected, even for different sizes of driver.

The first supply wire is preferably sealed within the first tube and the second supply wire is preferably sealed within the second tube. This provides a firm fixing for the wires within the tubes. For example, as explained below, the tubes may be sintered around the wires to provide a firm fixing. This enables robust electrical connections to be made.

The tubes are thus used to form a seal around their respective supply wires. The tubes can be for example be used for evacuating the envelope or filling the envelope with a gas after the envelope and stem portion have been connected.

In one example, the shape feature comprises a first through hole around the first wire and a second through hole around the second wire. In another example, the shape feature comprises a first slot around the first wire and a second slot around the second wire.

These holes or slots allow the lighting driver to slide over the first and second wires, and this provides positioning of the lighting driver during this sliding operation. They enable the lighting driver to be as large as the stem portion (in a plane perpendicular to the sliding direction). An alternative is for the lighting driver to slide between the first and second wires, but this will limit further the possible size of the lighting driver. The first and second wires may still perform a centering function by which the position of the driver is approximately defined (i.e. between the first and second wires), while it is pulled back towards the stem portion. After the driver has been pulled back to the stem portion, the relative positioning between the stem portion and the driver becomes fixed because the positions of the supply wires relative to the stem portion are then fixed, in particular at the locations of openings through the stem portion.

Any other suitable guiding arrangement may be used to define the path of the lighting driver between the remote position (before pulling back) and the pulled back position against the stem portion.

In one arrangement, the lighting driver comprises an anode output wire and a cathode output wire which are soldered to the first wire and second wire respectively. This soldered connection may take place as part of the process of also connecting an LED arrangement between the first wire and the second wire.

Alternatively, the holes or slots may be electrically connected to output terminals of the lighting driver. For example they may be formed in a printed circuit board, for example comprising conducting vias. The output terminals of the lighting driver are then connected the first and second wires by electrical contact between the first and second wires and the holes or slots.

In all cases, no access to the internal envelope volume is needed after the stem portion is connected (e.g. sintered) to the envelope. Soldered electrical connections to the driver may be provided, or else by positioning the lighting driver in place, for example abutted against the stem portion, the electrical connections between the first and second wires to output terminals of the lighting driver may be automatically ensured.

The envelope is preferably glass, and the stem portion is sintered to the envelope. During this sintering, the lighting driver can be positioned at a remote location from the stem, further into the envelope.

The first and second tubes are for example also glass and they are each sintered around their respective supply wire. This provides the thermal sealing of the envelope. The lighting driver can be in place next to the stem during this process despite the high temperature, because the tubes are on the opposite side of the stem portion to the lighting driver so the lighting driver is protected by the stem portion. The stem portion is for example also formed of glass.

The end cap for example further comprises a terminal portion which defines the first and second terminals. The assembly of the terminal portion to the stem portion is the final assembly stage.

As mentioned above, the LED arrangement is preferably connected between the first wire and the second wire. This connection is made after the lighting driver is mounted over the first and second wires, but before the stem portion is attached to the envelope.

The invention also provides a method of manufacturing a LED lighting bulb comprising:

providing an envelope having an opening;

providing a stem portion of an end cap, having a first wire and a second wire extending from the stem portion;

mounting a lighting driver along the first wire and second wire, wherein the lighting driver comprises first and second supply wires which extend through the stem portion and each through a respective tube which extends back from the stem portion;

providing an LED arrangement within the envelope;

hermetically connecting the stem portion to the opening of the envelope with the lighting driver remote from the stem portion and within the envelope;

pulling the lighting driver towards the stem portion along the first and second wires using the first and second supply wires;

connecting the lighting driver to the first and second wires;

sealing the tubes around the first and second supply wires;

assembling the end cap by connecting the first and second supply wires to first and second terminals of a terminal portion of the end cap and connecting the terminal portion to the stem portion.

This method enables a lighting driver to be positioned inside the bulb envelope and at a safe distance from the stem portion when the stem portion is attached to the envelope. The lighting driver can then be pulled into position using the supply wires. It may for example be pulled against the stem portion, so that it occupies a specific position abutted against the stem portion, but on the envelope side of the stem portion, i.e. within the bulb envelope rather than within the end cap.

Note that the connecting of the lighting driver to the first and second wires may take place automatically by pulling the lighting driver into position.

The envelope and the tubes are for example glass, and the hermetically connecting step and the sealing step comprise sintering. The sintering is a high temperature process, and the method avoids thermal damage to the lighting driver, which is already installed when the sintering takes place, because it is to be mounted inside the envelope.

The method may further comprise evacuating the envelope or filling the envelope with a gas before sealing the tubes around the first and second supply wires.

Pulling the lighting driver towards the stem portion using the first and second supply wires for example comprises pulling the lighting driver to slide relative to the first wire and the second wire along a shape feature of the lighting driver.

The method may further comprise connecting the lighting driver to the first and second wires by soldering before hermetically connecting the stem portion to the opening of the envelope (and indeed before the pulling step).

In an alternative arrangement, the shape feature for example comprises a first through hole or slot around the first wire and a second through hole or slot around the second wire, and the method comprises connecting the lighting driver to the first and second wires by electrically connecting the holes or slots to output terminals of the lighting driver during the step of pulling. The holes or slots for example have conductive inner surfaces which make electrical contact with the first or second wires.

The method may further comprise connecting the LED arrangement between the first wire and the second wire before hermetically connecting the stem portion to the opening of the envelope.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
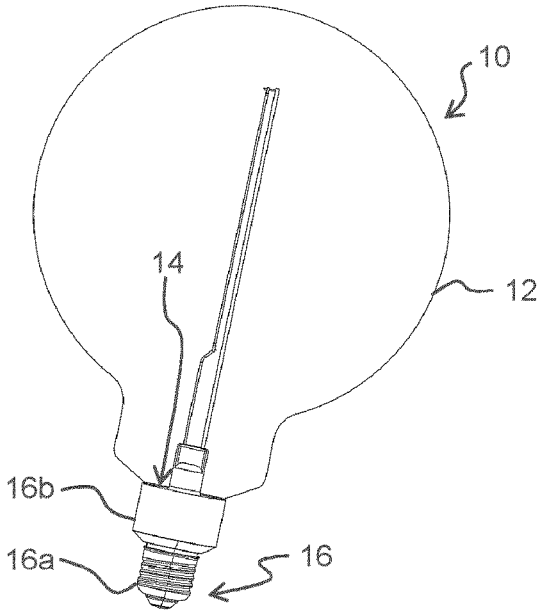
FIG. 1 shows a known LED bulb.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a LED lighting bulb in which a lighting driver is located within the bulb envelope. During assembly, the lighting driver may be positioned away from an opening of the envelope so that high temperature sealing of a stem portion of the end cap to the envelope opening can take place. The lighting driver can then be pulled into position against the stem portion, and assembly of the end cap can then be completed.

FIG. 1 shows a known LED bulb 10 comprising an envelope 12 having an opening 14. An end cap 16 is at the opening. The end cap defines the external electrical connector for connection to a bulb holder.

Within the volume of the end cap 16 is a lighting driver. To make space for the lighting driver in the end cap volume, outside the envelope 12 of the bulb, the end cap comprises a standard connector part 16*a* (such as a screw fitting as shown) and also an additional volume 16*b*.

As this additional volume 16*b* is normally enclosed by a non-transparent material, such as a metal/plastic over-molding housing, it changes the appearance of the bulb and may not be desired. It would be preferred to enable the connector to be as small as possible and to house the lighting driver in the envelope.

Figure 2:
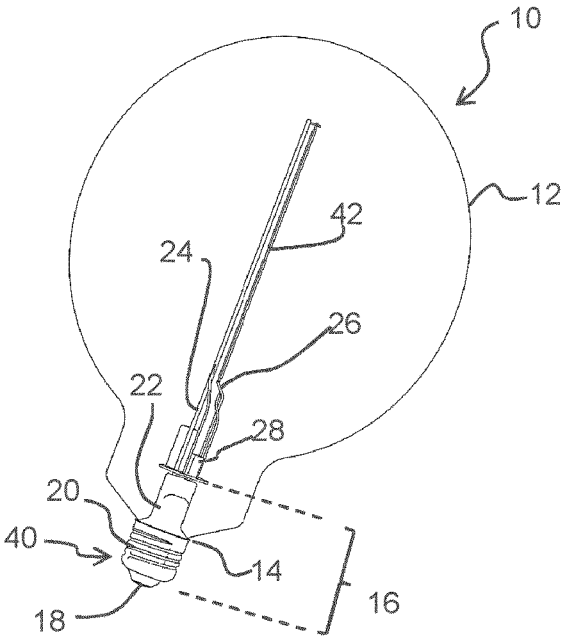
FIG. 2 shows a bulb in accordance with an example of the invention.

FIG. 2 shows a bulb in accordance with an example of the invention. The LED bulb 10 again comprising an envelope 12 in a bulbous shape, for example of glass, having an opening 14, and an end cap 16 at the opening.

The end cap 16 has an electrical connector part 40 with a first terminal 18 and a second terminal 20 for making electrical connection with a bulb holder.

The end cap further comprises a stem portion 22 which closes the opening in the envelope. A first wire 24 and a second wire 26 extend from the stem portion 22 into the envelope. The stem portion is the part that closes and therefore seals the envelope volume. It is also a glass component. Note that for the purposes of this description, the stem portion is considered to be part of the end cap. It could equally be considered to be a separate part to which the end cap connects.

The lighting driver 28 is positioned at an envelope side of the stem portion 22, namely within the envelope volume. The lighting driver 28 comprises a shape feature (described further below) for allowing the lighting driver to slide relative to the first wire 24 and the second wire 26, and the lighting driver 28 is electrically connected to the first wire and the second wire.

This shape feature allows the lighting driver to be located further towards the center of the envelope volume when the stem portion 22 is connected to the envelope. The lighting driver can then be pulled back to the stem portion.

An LED filament 42 is provided between the first wire and the second wire. This takes the form of one or more light emitting strips.

The bulb thus has the lighting driver on the envelope side of the stem portion of the end cap, i.e. within the bulb envelope. To protect the lighting driver during assembly, for example during sintering of the envelope to the stem portion (to seal the envelope), the lighting driver is slideable along the first and second wires.

The parts of the design of FIG. 2, and the way the assembly takes place, will be described with reference to FIGS. 3 to 9.

Figure 3:
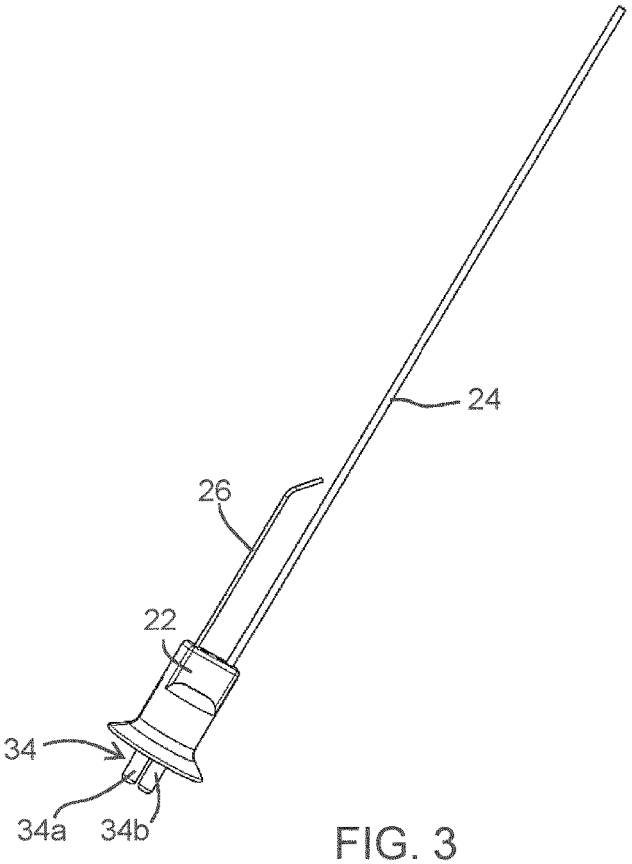
FIG. 3 shows the stem portion and connected wires and tubes.

FIG. 3 shows the stem portion 22, with the first wire 24 and second wire 26 projecting from a first side, in particular the envelope side (i.e. the side or end of the stem portion 22 which faces into the envelope volume when the bulb is assembled). The opposite side of the stem portion may be considered to be an end cap side.

Extending from the end cap side is a tube arrangement 34 comprising a first glass tube 34*a* and a second glass tube 34*b*.

Figure 4:
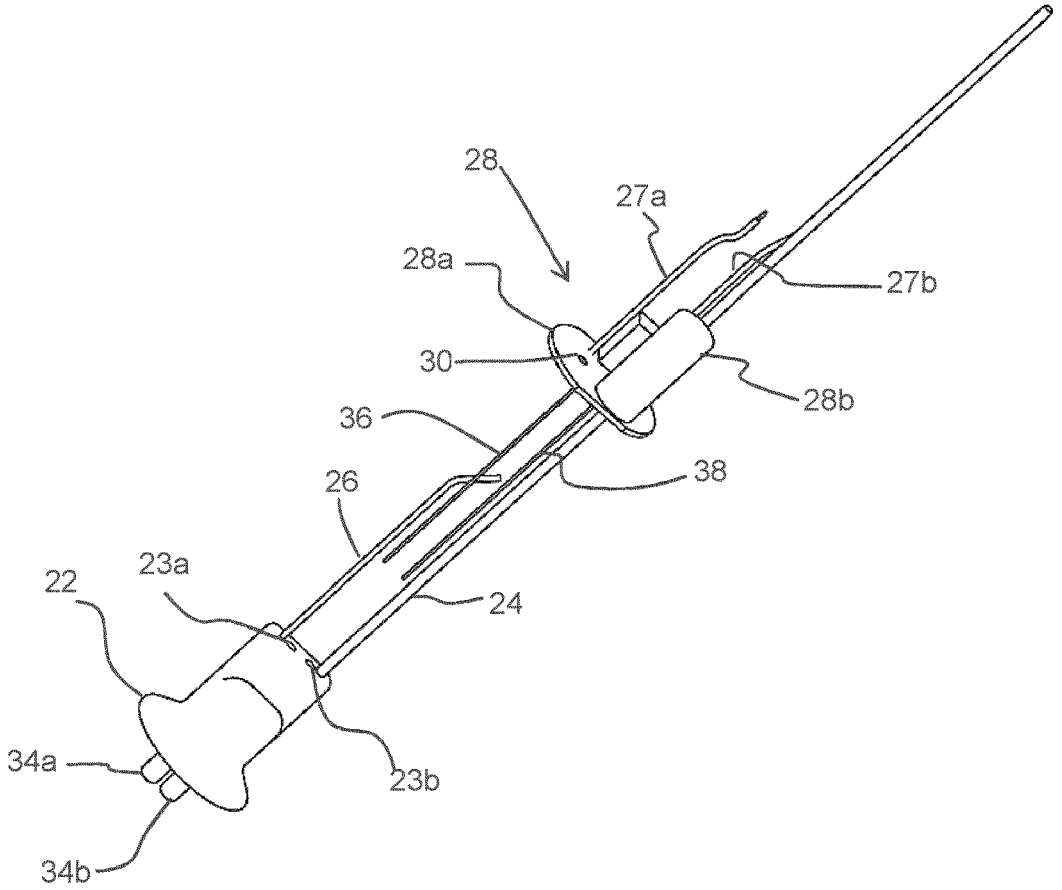
FIG. 4 shows the lighting driver mounted over the first wire.

FIG. 4 shows the lighting driver 28 mounted over the first wire 24. In FIG. 4 it is shown initially mounted over the first wire 24, but it is then slid down until it also passes over the second wire 26.

The lighting driver comprises a circuit board 28*a* and components 28*b* mounted on the circuit board 28*a*. A driver output anode cable 27*a* and a driver output cathode cable 27*b* extend from the circuit board 28*a* for soldering with the first wire 24 and second wire 26 respectively to provide the electrical output connections from the driver.

A shape feature is provided for allowing the lighting driver to slide relative to the first wire 24 and the second wire 26. This shape feature for example comprises a pair of openings, one opening 30 of which can be seen in FIG. 4 which will slide over the second wire 26 when the lighting driver 28 is lowered further towards the stem portion 22.

It is noted that the openings (such as opening 30) may instead be radially opening slots.

A first supply wire 36 extends from the lighting driver 28, through a first opening 23*a* in the stem portion 22 and through the first tube 34*a*. A second supply wire 38 extends from the lighting driver 28, through a second opening 23*b* in the stem portion 22 and through the second tube 34*b*. The first and second supply wires make electrical contact with input terminals of the lighting driver.

The first supply wire 36 is for making electrical connection between the first terminal 18 and a first input terminal of the lighting driver through the first tube 34*a* and through the stem portion 22; and the second supply wire 38 is for making electrical connection between the second terminal 20 and a second input terminal of the lighting driver 28 through the second tube 34*b* and through the stem portion.

Figure 5:
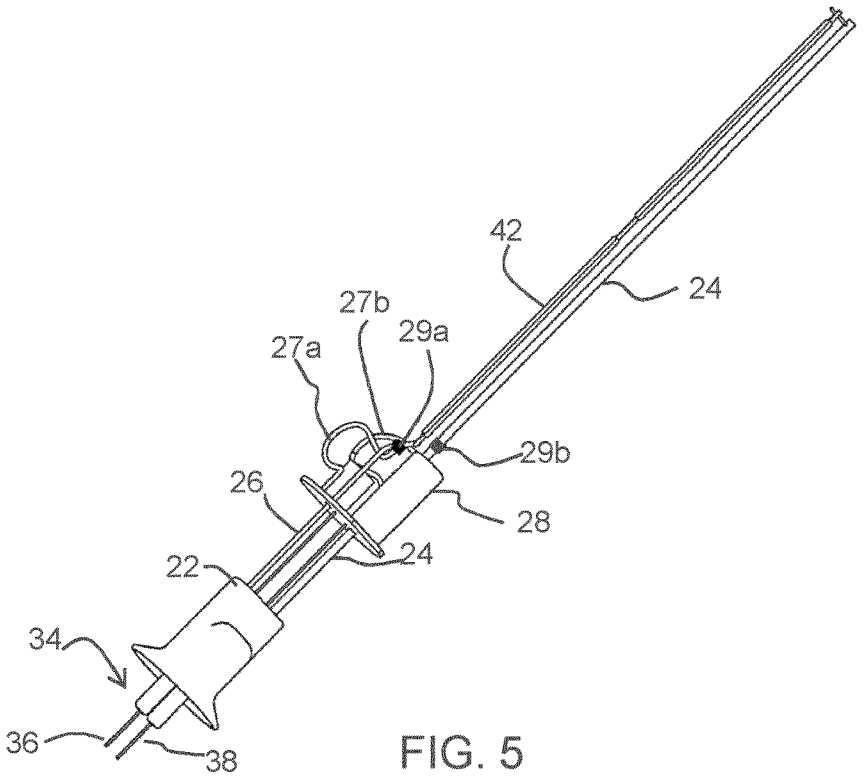
FIG. 5 shows the lighting driver mounted further down over both the first wire and the second wire.

FIG. 5 shows the lighting driver 28 mounted over both the first wire 24 and the second wire 26. The LED string 42 can then be connected between the first wire and second wire.

Furthermore, the driver output anode cable 27*a* connects to the first wire at location 29*a* and the driver output cathode cable 27*b* connects to the second wire at location 29*b*. This is by for example soldering. As shown in FIG. 5, there is slack in the cables 27*a*, 27*b* so that the driver 28 is free to slide towards the stem portion, which will result in straightening of the cables 27*a*, 27*b*.

Figure 6:
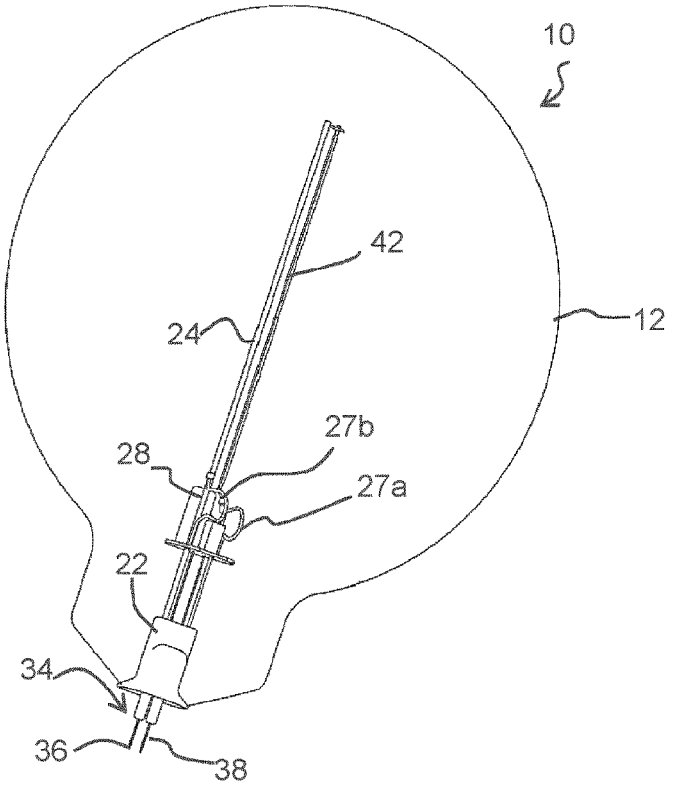
FIG. 6 shows the assembly of FIG. 5 inserted into the bulb envelope.

FIG. 6 shows that the assembly of FIG. 5 is then inserted into the bulb envelope 12. The stem portion closes the opening of the envelope. A sintering process is then used to seal the stem portion to the envelope.

During this sintering process, the lighting driver 28 is positioned spaced apart from the stem portion, as shown. Thus, it is not in contact with the stem portion, but there is an air gap between them. This prevents direct thermal conduction to the lighting driver 28 and protects the lighting driver from the sintering temperature. The spacing is for example more than 5 mm, for example more than 1 cm.

Figure 7:
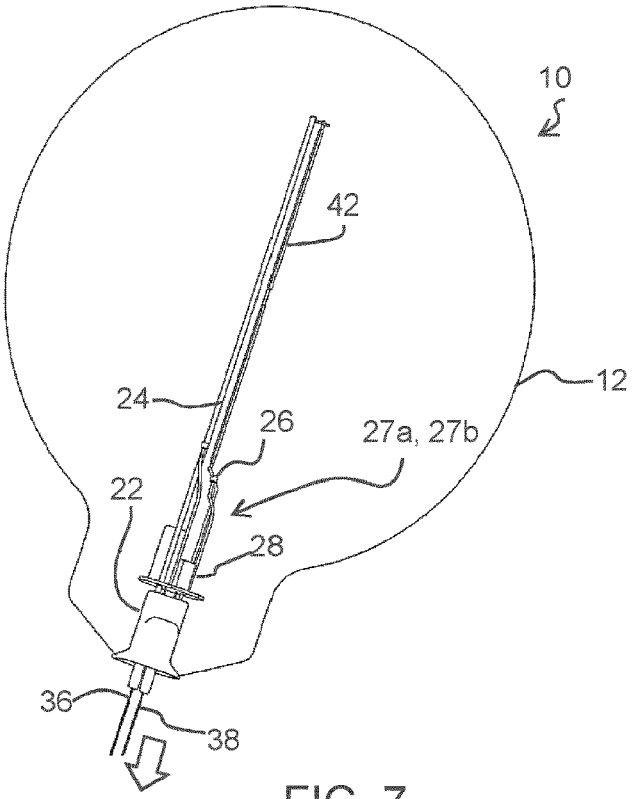
FIG. 7 shows how the supply wires are pulled to move the lighting driver towards the stem portion.

FIG. 7 shows how the supply wires 36, 38 are then pulled to move the lighting driver 28 towards the stem portion 22, preferably until it makes contact with the stem portion 22. The driver output anode cable 27*a* and the driver output cathode cable 27*b* are straightened during this process.

Figure 8:
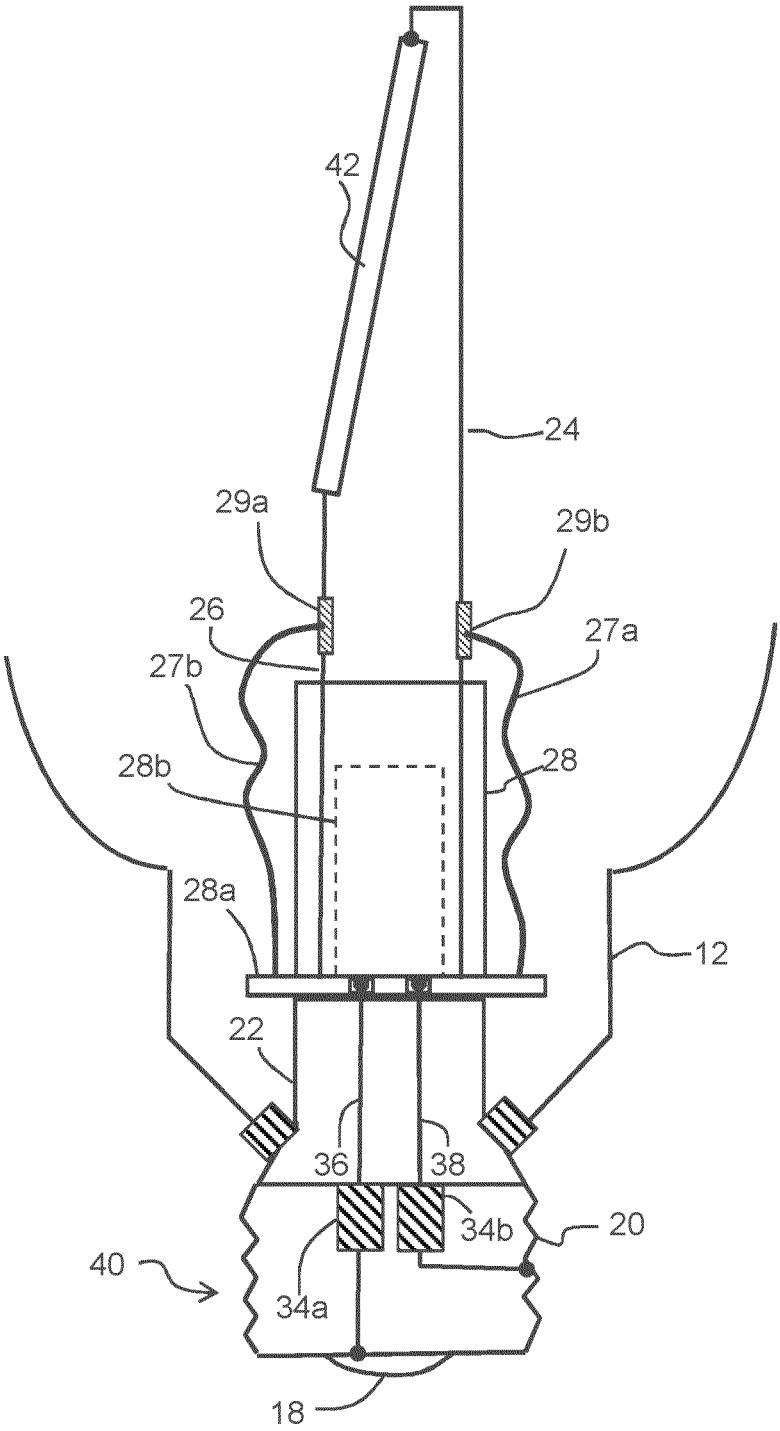
FIG. 8 shows the electrical connections in more detail.

As shown most clearly in FIG. 8, the first supply wire 36 is then is sealed within the first tube 34*a* and the second supply wire 38 is sealed within the second tube 34*b*. This is a further sintering process.

This process provides a hermetic seal to the interior volume of the envelope (and the seal between the stem portion 22 and the opening is also hermetic). The tubes may be used to evacuate the envelope volume or to provide a gas such as a gas with a high coefficient of thermal conductivity and low viscosity. Helium or hydrogen or a mixture thereof may be used, and this can reduce the heat sink requirements.

FIG. 8 shows more clearly the electrical connections and shows that the driver inputs 36 and 38 contact with the end cap, whereas the driver output cables 27*a* and 27*b* are soldered to the first wire 24 and the second wire 26 at soldering points 29*a* and 29*b*.

The end cap 16 is then assembled. This involves connecting the first supply wire 36 to the first terminal 18 and connecting the second supply wire 38 to the second terminal 20, as shown. The end cap is thereby assembled, by coupling the stem portion 22 and the terminal portion 40.

Figure 9:
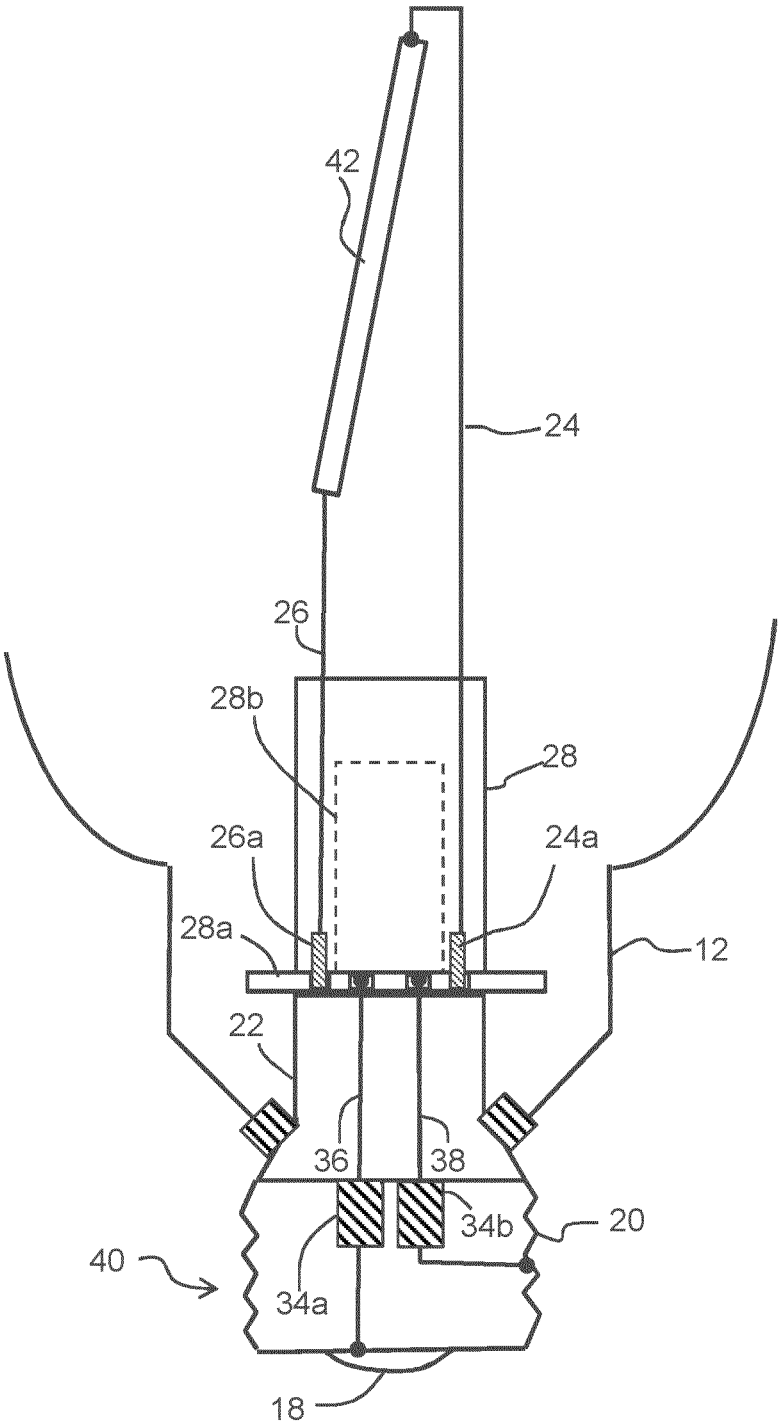
FIG. 9 shows an alternative design for the electrical connections.

FIG. 9 shows an alternative electrical connection arrangement. The first and second wires 24, 26 each comprise a respective enlarged foot portion 24*a*, 26*a*. The PCB 28*a* of the lighting driver 28 comprises conductive vias as the openings 30. When the lighting driver 28 is fully retracted to abut against the stem portion 22, the enlarged foot portions 24*a*, 26*a* make electrical contact and frictional engagement with the conductive vias. Thus the output of the lighting driver is connected to the first wire and second wire for driving the LED filament in an automatic way without needing additional soldered wires. The other features are the same as in FIG. 8.

Any other electrical contact design may be used by which the movement of the lighting driver 28 into its final position results in an electrical connection being made between the lighting driver output terminals and the first and second wires. Also, instead of soldered connection wires, other types of electrical connections may be made such as using electrical connectors.

Figure 10:
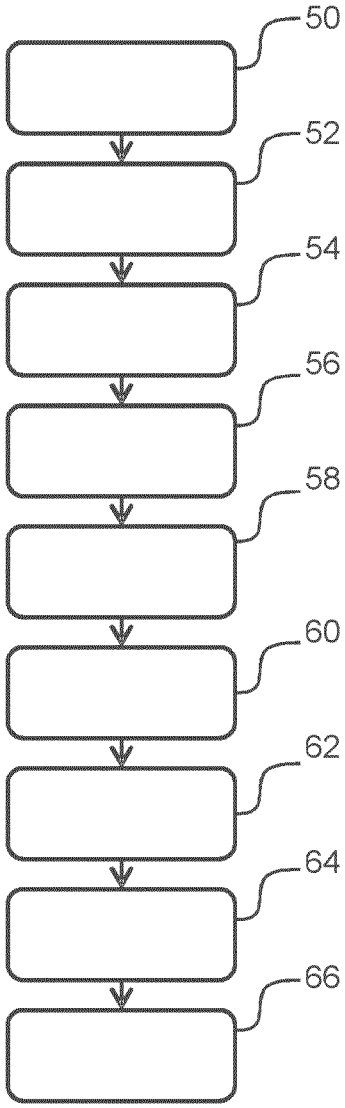
FIG. 10 shows a method of manufacturing a LED lighting bulb.

FIG. 10 shows a method of manufacturing a LED lighting bulb.

In step 50, an envelope is provided having an opening.

In step 52, a stem portion of an end cap is provided, having a first wire and a second wire extending from the stem portion (shown in FIG. 3). A pair of tubes also extend back from the stem portion on the opposite side to the first and second wires.

In step 54, a lighting driver is mounted along the first wire and second wire (shown in FIG. 4). The lighting driver comprises first and second supply wires which extend through the stem portion and each through a respective one of the tubes.

In step 56, an LED arrangement is connected between the first wire and the second wire and, for the design of FIG. 8, soldered electrical connections are made between the first wire and second wire and the driver output cables.

In step 58, the stem portion is hermetically connected to the opening of the envelope with the lighting driver remote from the stem portion and within the envelope (shown in FIG. 6), preferably by sintering.

In step 60, the lighting driver is pulled towards the stem portion along the first and second wires using the first and second supply wires (shown in FIG. 7). For the design of FIG. 9, this step 60 creates the electrical connections between the first wire and second wire and the driver outputs.

In step 62, the envelope is optionally evacuated or filled with a gas.

In step 64, the tubes are sealed around the first and second supply wires, preferably by sintering.

In step 66, the end cap is assembled by connecting the first and second supply wires to first and second terminals of the terminal portion of the end cap and connecting the terminal portion to the stem portion.

The example above is based on one envelope shape and one end cap design. The invention may of course be applied to other designs. The LED arrangement may take any desired form with a single color or a controllable color, and the invention can be applied to any type of driver. There may be additional circuit components in the end cap or as part of the lighting driver, such as sensors, or RF communications circuits to enable remote wireless control. Thus, the invention may be applied to a variety of bulb types.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A LED lighting bulb comprising:

an envelope having an opening;

an LED arrangement being enclosed in the envelope;

an end cap at the opening comprising a first terminal, a second terminal and a stem portion which closes the opening;

a first wire and a second wire extending from the stem portion into the envelope;

a lighting driver at an envelope side of the stem portion, the lighting driver comprising a shape feature for allowing the lighting driver to slide relative to the first wire and the second wire during assembly, and the lighting driver being electrically connected to the first wire and the second wire;

a first tube extending from the stem portion on an opposite side to the envelope;

a second tube extending from the stem portion on the opposite to the envelope; and a first supply wire which makes electrical connection between the first terminal and the lighting driver through the first tube and through the stem portion; and a second supply wire which makes electrical connection between the second terminal and the lighting driver through the second tube and through the stem portion.

2. A LED lighting bulb as claimed in claim 1, wherein the first supply wire is sealed within the first tube and the second supply wire is sealed within the second tube.

3. A LED lighting bulb as claimed in claim 1, wherein the shape feature comprises a first through hole or slot around the first wire and a second through hole or slot around the second wire.

4. A LED lighting bulb as claimed in any claim 1, wherein the lighting driver comprises an anode output wire and a cathode output wire which are soldered to the first wire and second wire respectively.

5. A LED lighting bulb as claimed in claim 1, wherein the holes or slots are electrically connected to output terminals of the lighting driver and the output terminals of the lighting driver are connected the first and second wires by electrical contact between the first and second wires and the holes or slots.

6. A LED lighting bulb as claimed in claim 1, wherein the envelope is glass and the stem portion is sintered to the envelope.

7. A LED lighting bulb as claimed in claim 1, wherein the first and second tubes are glass and they are each sintered around their respective supply wire.

8. A LED lighting bulb as claimed in claim 1, wherein the end cap further comprises a terminal portion which defines the first and second terminals.

9. A LED lighting bulb as claimed in claim 1, wherein the LED arrangement is connected between the first wire and the second wire.

10. A method of manufacturing a LED lighting bulb comprising:

providing an envelope having an opening;

providing a stem portion of an end cap, having a first wire and a second wire extending from the stem portion;

mounting a lighting driver along the first wire and second wire, wherein the lighting driver comprises first and second supply wires which extend through the stem portion and each through a respective tube which extends back from the stem portion;

providing an LED arrangement within the envelope;

hermetically connecting the stem portion to the opening of the envelope with the lighting driver remote from the stem portion and within the envelope;

pulling the lighting driver towards the stem portion along the first and second wires using the first and second supply wires;

sealing the tubes around the first and second supply wires;

assembling the end cap by connecting the first and second supply wires to first and second terminals of a terminal portion of the end cap and connecting the terminal portion to the stem portion.

11. A method as claimed in claim 10, wherein the envelope and the tubes are glass, and the hermetically connecting and the sealing comprise sintering.

12. A method as claimed in claim 10, further comprising evacuating the envelope or filling the envelope with a gas before sealing the tubes around the first and second supply wires.

13. A method as claimed in claim 10, wherein pulling the lighting driver towards the stem portion using the first and second supply wires comprises pulling the lighting driver to slide relative to the first wire and the second wire along a shape feature of the lighting driver.

14. A method as claimed in claim 10, further comprising connecting the lighting driver to the first and second wires by soldering before hermetically connecting the stem portion to the opening of the envelope.

15. A method as claimed in claim 11, further comprising connecting the LED arrangement between the first wire and the second wire before hermetically connecting the stem portion to the opening of the envelope.

* * * * *